US005080014A

United States Patent [19]

Hofheinz

[11] Patent Number: 5,080,014

[45] Date of Patent: Jan. 14, 1992

[54] DEVICE FOR ELASTICALLY DEFORMING A PRINTING PLATE

[75] Inventor: Walter Hofheinz, Heidelberg, Fed. Rep. of Germany

[73] Assignee: Heidelberger Druckmaschinen AG, Heidelberg, Fed. Rep. of Germany

[21] Appl. No.: 597,824

[22] Filed: Oct. 15, 1990

[30] Foreign Application Priority Data

Oct. 14, 1989 [DE] Fed. Rep. of Germany ..... 3934334

[51] Int. Cl.[5] ..... B41F 27/12

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 4,157,067 | 6/1979 | Dätwyler | 101/415.1 |
| 4,596,188 | 6/1986 | Bonomi | 101/415.1 |
| 4,712,476 | 12/1987 | Jeschke | 101/415.1 |
| 4,785,736 | 11/1988 | Jeschke | 101/415.1 |
| 4,831,931 | 5/1989 | Jeschke et al. | 101/415.1 |

FOREIGN PATENT DOCUMENTS

| | | | |
|---|---|---|---|
| 0331777 | 9/1989 | European Pat. Off. | 101/415.1 |
| 1178443 | 9/1964 | Fed. Rep. of Germany | 101/415.1 |
| 3604071 | 8/1987 | Fed. Rep. of Germany | 101/415.1 |
| 3843395 | 7/1989 | Fed. Rep. of Germany | 101/415.1 |
| 0193828 | 8/1987 | Japan | 101/415.1 |
| 0173645 | 7/1988 | Japan | 101/415.1 |
| 2191347 | 12/1987 | United Kingdom . | |

*Primary Examiner*—Eugene H. Eickholt

*Attorney, Agent, or Firm*—Herbert L. Lerner; Laurence A. Greenberg

[57] ABSTRACT

A device for elastically deforming a printing plate clamped on a plate cylinder having a longitudinal channel formed therein includes a first tensioning device mounted in the longitudinal channel for tensioning the printing plate in circumferential direction of the plate cylinder, a second tensioning device for elastically deforming an end of the printing plate in longitudinal direction of the plate cylinder, and a servomotor connected to the second tensioning device for actuating the second tensioning device, the second tensioning device including an hydraulic power converter.

6 Claims, 3 Drawing Sheets

Fig.1
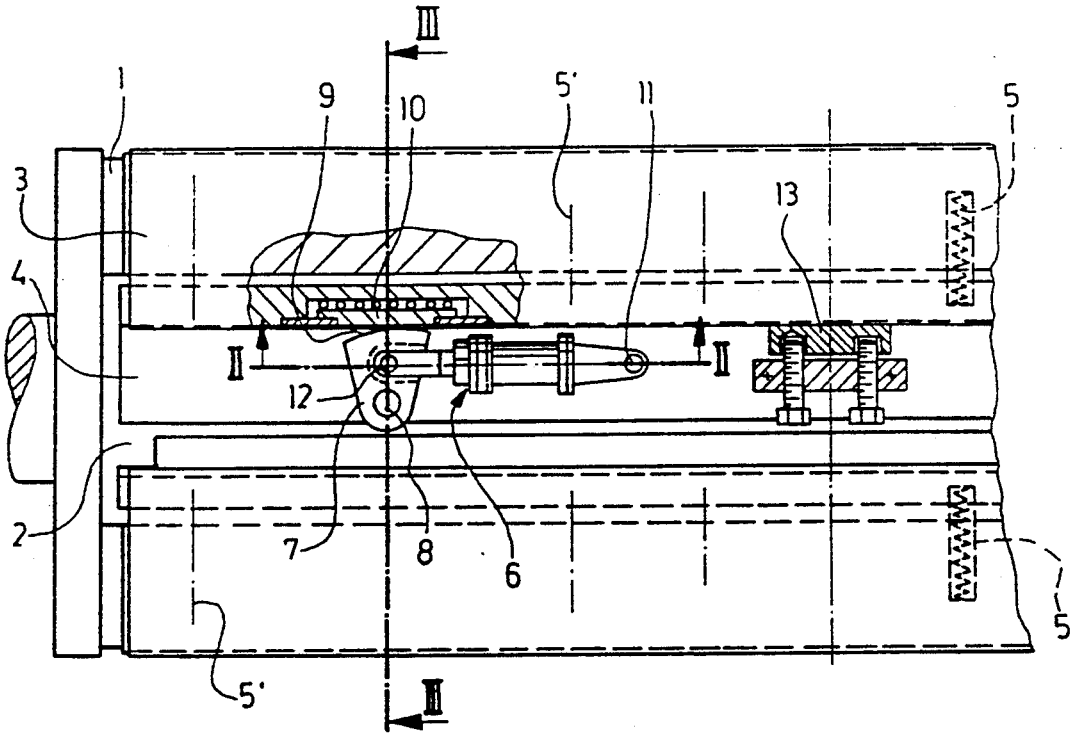
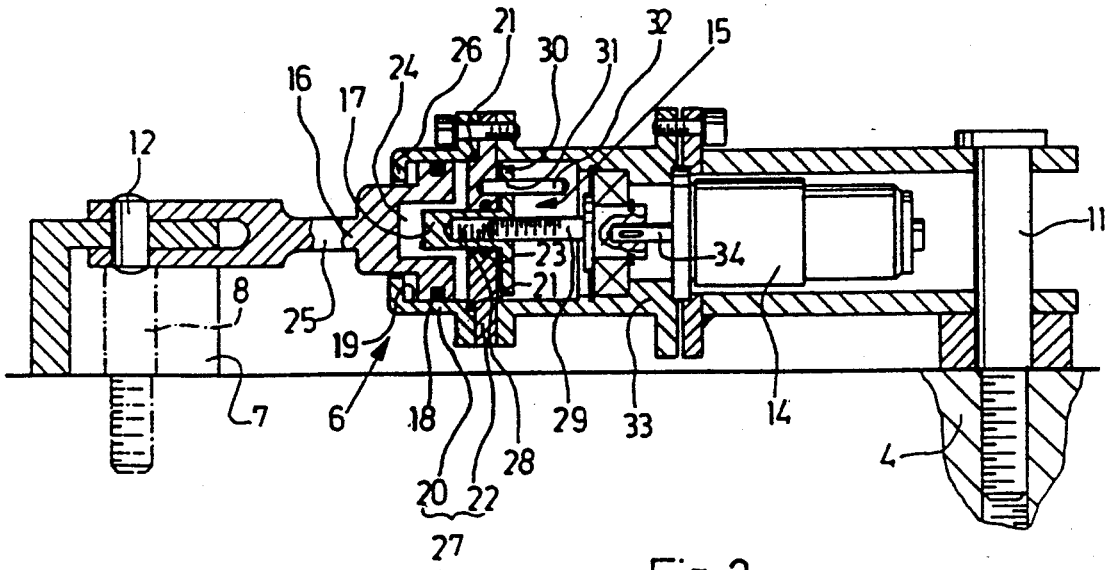
Fig.2

DEVICE FOR ELASTICALLY DEFORMING A PRINTING PLATE

The invention relates to a device for elastically deforming a printing plate and, more particularly, a printing plate clamped on a plate cylinder having a longitudinal channel formed therein, the device including first tensioning means mounted in the longitudinal channel for tensioning the printing plate in circumferential direction of the plate cylinder, and second tensioning means for elastically deforming an end of the printing plate in longitudinal direction of the plate cylinder, the second tensioning means being actuatable by a servomotor.

Such a device has become known heretofore from U. S. Pat. No. 4,712,476 assigned to the same corporate assignee as that of the instant application. In this device, the second tensioning means, which have been provided for transmitting a deformation force acting in the longitudinal direction of the plate cylinder to the printing plate, have a tensioning element in the form of a tensioning segment with an eccentric clamping surface, the tensioning segment being swivel-mounted on a tensioning rail of the first tensioning means. A folded or bent-over end portion of an end of the printing plate is clamped in a self-locking manner between a counterbearing carried by the tensioning rail, and the tensioning segment.

An output or driven shaft is connected to the tensioning segment in a manner that the latter is swivellable by the servomotor. For this purpose, there is provided between the tensioning segment and the output or driven shaft, a unit formed of a spindle nut and a threaded spindle, by means of which the rotary motion of the output or driven shaft is converted into a swivelling motion of the tensioning segment. Servomotors suitable for this purpose must have a relatively high starting torque and, consequently, the servomotor must also require a relatively high power consumption and must be correspondingly large in size. As necessary as a high starting torque may be for this purpose, this may, nevertheless, have such a disadvantageous effect that a more-or-less sudden or abrupt transmission of the deformation force to the printing plate can occur.

It is accordingly an object of the invention to provide a device for elastically deforming a printing plate wherein the space necessary for accommodating the servomotor is held to a minimum.

It is also an object of the invention to provide a device for elastically deforming a printing plate which overcomes the hereinafore-mentioned disadvantages of the heretofore-known devices of this general type.

With the foregoing and other objects in view there is provided, in accordance with the invention, a device for elastically deforming a printing plate clamped on a plate cylinder having a longitudinal channel formed therein, comprising first tensioning means mounted in the longitudinal channel for tensioning the printing plate in circumferential direction of the plate cylinder, second tensioning means for elastically deforming an end of the printing plate in longitudinal direction of the plate cylinder, and a servomotor connected to the second tensioning means for actuating the second tensioning means, the second tensioning means including an hydraulic power converter. By furnishing the second tensioning means with an hydraulic power converter, the required starting torque can be considerably reduced.

Accordingly, relatively small servomotors with correspondingly low power consumption can be used.

Another advantage of this construction of the device, is that the power supply to such a servomotor may also be provided, for example, by an electrical energy-storage device which is accommodated within the plate cylinder.

A further advantage results from the fact that the hydraulic power converter having a transmission ratio smaller than 1 for forces or power values acts also as a displacement or travel distance converter which has a transmission ratio greater than 1 for displacements or travel distances. When the rotary motion of the output or driven shaft of the servomotor is converted to a positioning motion of the tensioning element of the second tensioning means with the aid of a unit formed of a spindle nut and a threaded spindle, a specific positioning travel of the tensioning element thus corresponds, when the power converter is used, to a greater number of revolutions of the output or driven shaft than would result, without the application of the power converter, from the ratio of the positioning travel to the thread pitch of the unit formed of the spindle nut and the threaded spindle. The foregoing advantage thus resides in the capability of setting or adjusting the positioning travel of the tensioning element more finely, i.e., with greater accuracy.

In accordance with another feature of the invention, the hydraulic power converter includes a working piston, a control piston having a diameter smaller than the diameter of the working piston, and an hydraulic-fluid supply enclosed in a housing between the working piston and the control piston, the housing being a guide for the working piston and the control piston.

In this regard, the power converter is a closed system with respect to the hydraulic fluid. Such a system can thus be integrated without inlet and outlet lines into the device for elastically deforming a printing plate in accordance with the invention.

In accordance with a further feature of the invention, the device includes a transmission drivable by an output shaft of the servomotor, the transmission having a translatorially adjustable output element for adjusting the control piston.

In this regard, for example, the control piston can be formed as a spindle nut which is fixed against rotation and which is in operative engagement with a rotatably mounted threaded spindle which is fixed with respect to the power converter, the threaded spindle having a torque-transmitting connection to the output or driven shaft of the servomotor. The transmission may also, however, be constructed as a worm gear with which, for each revolution of the output or driven shaft of the servomotor, there is an advance of the translatorially adjustable output element having a magnitude which corresponds to the difference between the thread pitches of two threaded transmission elements, so that a further increase in the fine adjustment of the tensioning element and, consequently, also a relatively slow increase in the deformation force can be achieved.

In accordance with an added feature of the invention, the working piston and the control piston are arranged coaxially to one another, and the working piston is formed with a central blind bore for receiving the control piston therein, a lateral wall defining the blind bore and the control piston defining an annular gap therebetween. This construction affords a saving in space with respect to the accommodation of the power converter.

In accordance with an additional feature of the invention. the device includes an adjustable tensioning element braced against the first tensioning means for applying a deformation force acting in the longitudinal direction of the plate cylinder to the printing plate, the tensioning element being articulatingly connected to the working cylinder.

In accordance with another aspect of the invention, there is provided, in a device for elastically deforming a printing plate clamped onto a plate cylinder, tensioning means for elastically deforming an end of the printing plate in the longitudinal direction of the plate cylinder, the tensioning means comprising an hydraulic power converter.

Although the invention is illustrated and described herein as embodied in a device for elastically deforming a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary top plan view, partly broken away and partly in section, of a plate cylinder in a position thereof wherein the longitudinal channel formed therein is located at the top thereof, and showing the device for elastically deforming a printing plate, in accordance with the invention, at an end portion of the longitudinal channel;

FIG. 2 is an enlarged fragmentary longitudinal sectional view of FIG. 1 taken along the line II—II in the direction of the arrows;

Figure 3:
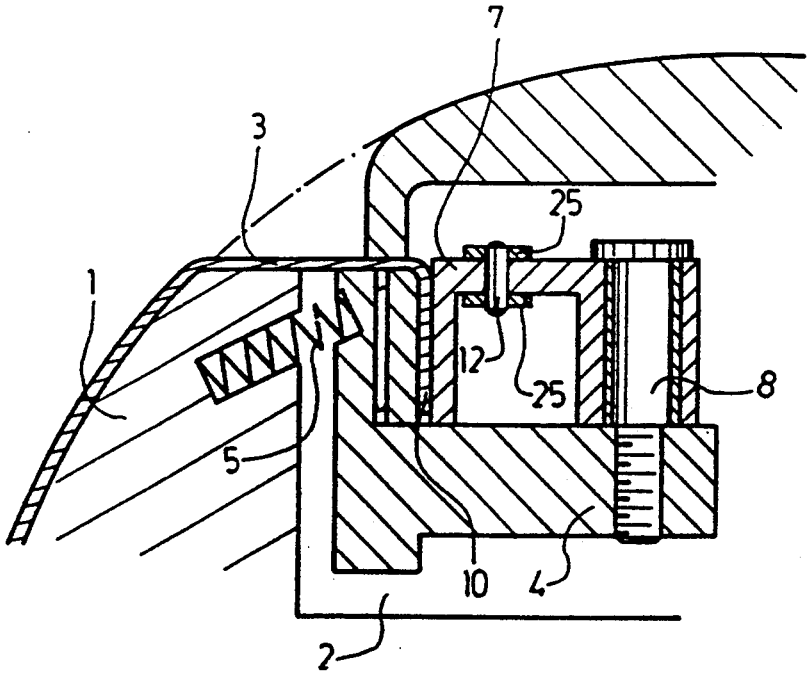
FIG. 3 is an enlarged fragmentary cross-sectional view of FIG. 1 taken along the line III—III in the direction of the arrows.

Referring now to the figures of the drawing in detail and first, particularly, to FIG. 1 thereof, there is shown therein a plate cylinder 1 formed with a longitudinal channel 2 wherein a first tensioning means described hereinafter in greater detail is accommodated, a leading and a trailing end of a printing plate 3 wound around the plate cylinder 1 being gripped by the first tensioning means which subjects the printing plate 3 to tension in the circumferential direction of the plate cylinder 1. A second tensioning means described hereinafter in greater detail is also accommodated in the longitudinal channel 2 in association with an end of the printing plate 3, this end of the printing plate 3 being elastically deformable by the second tensioning means in the longitudinal direction of the plate cylinder 1.

The first tensioning means which, as aforedescribed, is associated with an end of the printing plate 1 has a tensioning rail 4 braced against the plate cylinder 1 by springs 5 distributed at locations represented by center lines 5' substantially across the printing plate 1, i.e., extending along the length of the longitudinal channel. With respect to any further details of the construction and function of the tensioning rail 4, reference may be had to U.S. Pat. No. 4,712,476 mentioned in the introduction hereto wherein an arrangement similar to that of the first tensioning rail of the instant application is disclosed.

The second tensioning means are braced against the tensioning rail 4 and have a tensioning element 7 formed as a tensioning segment adjustable by means of an adjustment device 6. The tensioning element or segment 7, on the one hand, is articulatingly connected by a pin 8 to the tensioning rail 4 so as to swivel thereon and, on the other hand, is brought into clamping engagement with a folded or bent-over end portion 10 (FIG. 3) of the printing plate 1 by means of a clamping surface formed on the tensioning segment 7 and disposed eccentrically to the pin 8. The adjustment device 6 is also articulatingly connected, on the one hand, by means of a pin 11 to the tensioning rail 4 so as to swivel thereon and, on the other hand, by means of another pin 12 to the tensioning segment 7 so as to swivel thereon.

Part of the bent-over end portion 10 disposed within a range of influence of the tensioning segment 7 is braced against an underside of the printing plate 3 which faces towards the plate cylinder 1 so that, within this range of influence, the printing plate 3 can be shifted in the longitudinal direction of the plate cylinder 1 with reduced friction. With respect to the measures and means suited in this regard for clamping the printing plate 3 on and to the tensioning rail 4 in a region of the longitudinal center of the plate cylinder 1 by means of clamping jaws 13, reference may be had again to the aforementioned U.S. Pat. No. 4,712,476.

When the clamping jaws 13 are tightened, a deforming force acting in the longitudinal direction of the plate cylinder 1 is applicable via the clamping surface 9 by the tensioning segment 7, within the range of influence thereof, on the bent-over end 10 of the printing plate 3 by suitably adjusting the adjustment device 6 and accordingly swivelling the tensioning segment 7 about the pin 8.

Adjustment of the tensioning segment 7 and the second tensioning means which include the adjustment device 6 is effected by means of a servomotor 14 in a manner described hereinafter in detail.

According to the invention, the second tensioning means have an hydraulic power converter 15.

FIG. 2 shows an embodiment of such a power converter 15 and its manner of integration into the second tensioning means.

A force conversion is effected thereby from the interplay of a working piston 16 and a control piston 17 having a diameter which is smaller than the diameter of the working piston 16. The working piston 16 is guided on an interior surface 19 of a cylindrical casing 20 through the intermediary of a sealing ring 18. An end of the cylindrical casing 20 is closed by an end wall 22 through the intermediary of another sealing ring 21. The control piston 17 extends coaxially to the working piston 16, through the intermediary of yet another sealing ring 23, into a central bore formed in the end wall 22. A supply 24 of hydraulic fluid is enclosed within a housing 27 defined by the cylindrical casing 20 and the end wall 22.

An immersion of the control piston 17 as a result of an adjusting force into the hydraulic-fluid supply 24 produces a compressive force greater than this adjusting force which is exerted by the hydraulic-fluid supply 24 upon the working piston 16, due to the difference in diameter of the working piston 16 and the control piston 17. This compressive force is transmitted to the tensioning segment 7 by means of a piston rod 25 connected to the working piston 16 and articulatingly connected by means of the pin 12 to the tensioning segment 7, and swivels the tensioning segment 7 with respect to the pin 8, a deformation force resulting from the aforementioned compressive force being transmitted by means of the eccentric clamping surface 9 of the tensioning segment 7 to the bent-over end portion 10 of the printing plate 3.

A radially inwardly extending shoulder 26 at the end of the cylindrical casing 20 facing away from the end wall 22 serves as a stop for the working piston 16 as it is shifted or displaced under the action of the aforementioned compressive force.

For the further aforementioned adjustment of the tensioning segment 7 and the second tensioning means which include the adjustment device 6, there are provided a transmission with a translatorially adjustable output or driven element connected between the control piston 17 and the servomotor 14 and driven by the latter, for shifting the control piston 17.

In the embodiment of the second tensioning means according to the invention shown in FIG. 2, the translatorially adjustable output or driven element is represented by an internal thread 28 of the control piston 17 extending coaxially to the longitudinal axis of the control piston 17. The control piston 17 is secured against torsion or rotation and represents accordingly a longitudinally displaceable spindle nut with respect to a stationary threaded spindle 29 cooperating with the internal thread 28. To provide the security against torsion or rotation of the control piston 17, the latter has a collar 30 formed with a guide bore 31 extending parallel to the threaded spindle 29, and a securing pin 32 is fastened in the end wall 22 and passes freely through the guide bore 31. The threaded spindle 29 cooperating with the internal winding 28 is mounted so as to be rotatable and secured against longitudinal displacement in a housing projection 33 flanged to the end wall 22, and is fixed against rotation with a driven or output shaft 34 of the servomotor 14 which, in turn, is flanged to the housing projection 33.

In this embodiment of FIG. 2, the transmission arranged between the servomotor 14 and the control piston 17 is a simple worm gear transmission. In this connection, a displacement of the control piston 17 by the amount of the thread pitch of the worm gear occurs for each revolution of the driven o output shaft 34.

Figure 4:
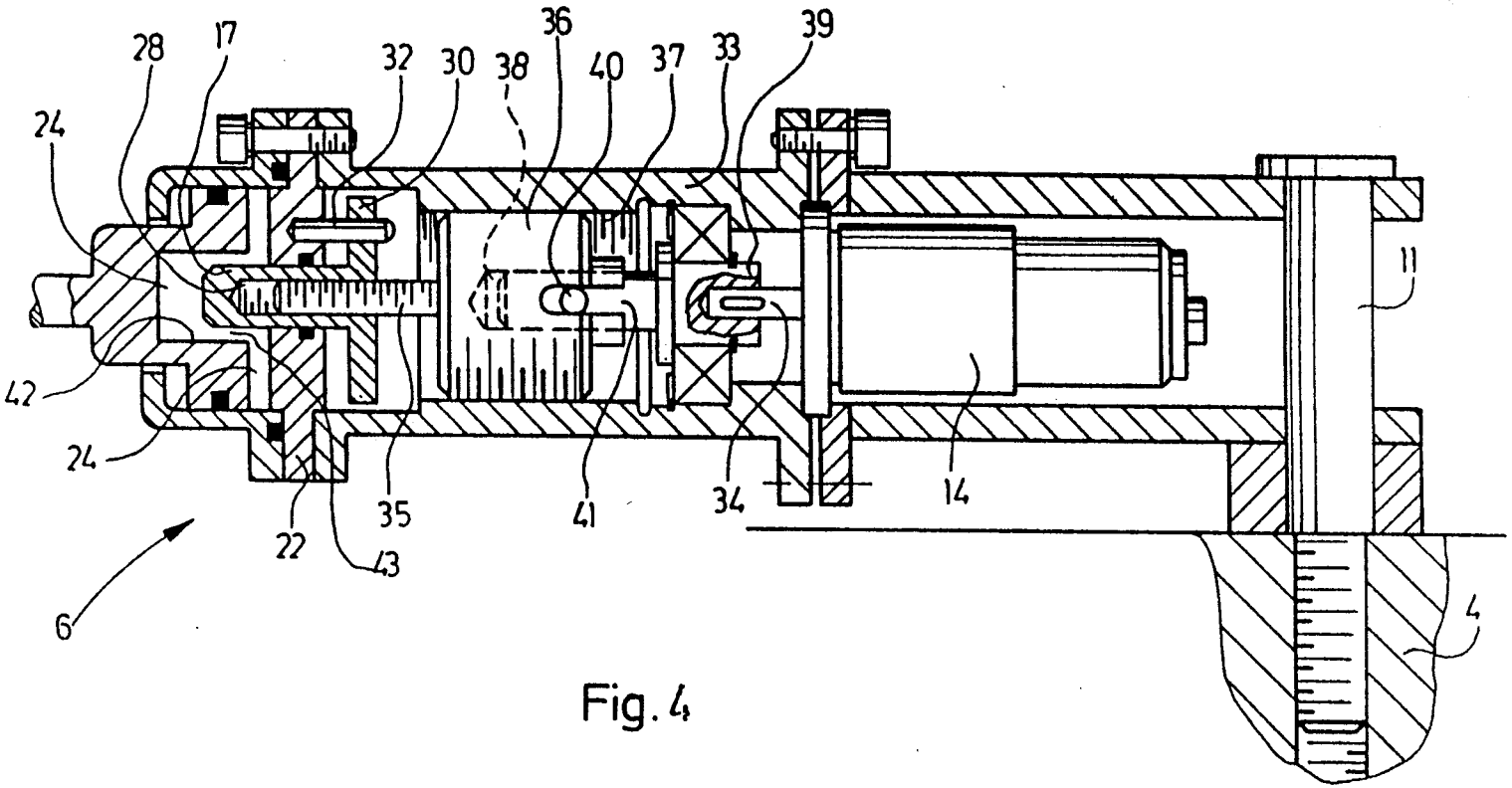
FIG. 4 is an enlarged fragmentary view of FIG. 2 illustrating another embodiment of a transmission between a servomotor and an hydraulic power converter forming part of the device according to the invention.

In the embodiment of the second tensioning means shown in FIG. 4, the translatorially adjustable output or driven element is likewise represented by the internal thread 28 of the control piston 17 which, in a manner similar to that of the embodiment illustrated in FIG. 2, is secured against torsion or rotation. Cooperating with the internal thread 28 is a threaded pin 35 which is firmly and concentrically connected to an externally threaded sleeve 36 which, in turn, is screwed coaxially with the control piston 17 into an internal thread 37 of the housing projection 33. In this connection, the respective threads of the threaded pin 35 and of the sleeve 36 have different pitches. An intermediate shaft 39 engages in a bore 38 formed in the sleeve 36 and extending coaxially to the threaded pin 35. The intermediate shaft 39 is mounted so as to be rotatable and in a fixed position in the housing projection 33, and firmly connected to the output or driven shaft 34 of the servomotor 14 so as to be rotatable therewith. A connection between the sleeve 36 and the intermediate shaft 39 is furthermore produced by an entrainer pin 40 of the intermediate shaft 39 and a slot 41 formed in the sleeve 36 so that they rotate together yet permit a longitudinal displacement of the sleeve 36 with respect to the intermediate shaft 39

In this embodiment of the invention, the transmission arranged between the servomotor 14 and the control piston 17, for each revolution of the output or driven shaft 34, produces a displacement of the control piston 17 by the amount of the difference between the different pitches of the respective threads of the threaded pin 35 and the sleeve 36.

As also in the case of the embodiment of the invention shown in FIG. 2, the control piston 17 of the embodiment of FIG. 4 is immersed in hydraulic fluid in a central blind bore 42 of the working piston 16, and forms an annular gap 43 between the lateral wall defining the blind bore 42 and the control piston 17. In this regard, the overall length of the adjustment device 6 is shortened.

The power supply for the servomotor 14, as mentioned hereinbefore, can be provided by any suitable electrical energy storage device accommodated in the plate cylinder 1. Recourse can be taken to the teachings in, for example, the published British Patent Application 2 191 347 for such an energy storage device.

The foregoing is a description corresponding in substance to German Application P 39 34 334.0, dated Oct. 14, 1989, the International priority of which is being claimed for the instant application, and which is hereby made part of this application. Any material discrepancies between the foregoing specification and the aforementioned corresponding German application are to be resolved in favor of the latter.

I claim:

1. A device for elastically deforming a printing plate clamped on a plate cylinder having a longitudinal channel formed therein, comprising first tensioning means mounted in the longitudinal channel for tensioning the printing plate in circumferential direction of the plate cylinder, second tensioning means for elastically deforming an end of the printing plate in longitudinal direction of the plate cylinder, and a servomotor connected to said second tensioning means for actuating said second tensioning means, said second tensioning means including an hydraulic power converter.

2. Device according to claim 1, wherein said hydraulic power converter includes a working piston, a control piston having a diameter smaller than the diameter of the working piston, and an hydraulic-fluid supply enclosed in a housing between said working piston and said control piston, said housing being a guide for said working piston and said control piston.

3. Device according to claim 2, including a transmission drivable by an output shaft of the servomotor, said transmission having a translatorially adjustable output element for adjusting said control piston.

4. Device according to claim 2, wherein said working piston and said control piston are arranged coaxially to one another, and said working piston is formed with a central blind bore for receiving said control piston therein, a lateral wall defining said blind bore and said control piston defining an annular gap therebetween.

5. Device according to claim 2, including an adjustable tensioning element braced against said first tensioning means for applying a deformation force acting in the longitudinal direction of the plate cylinder to the printing plate, said tensioning element being articulatingly connected to said working cylinder.

6. In a device for elastically deforming a printing plate clamped onto a plate cylinder, tensioning means for elastically deforming an end of the printing plate in the longitudinal direction of the plate cylinder, the tensioning means comprising an hydraulic power converter.

* * * * *